US008164243B2

(12) United States Patent
Nunome et al.

(10) Patent No.: US 8,164,243 B2
(45) Date of Patent: Apr. 24, 2012

(54) SPARK PLUG FOR INTERNAL COMBUSTION ENGINE

(75) Inventors: Kenji Nunome, Nagoya (JP); Yoshikuni Sato, Nagoya (JP)

(73) Assignee: NGK Spark Plug Co., Ltd. (JP)

( * ) Notice: Subject to any disclaimer, the term of this patent is extended or adjusted under 35 U.S.C. 154(b) by 242 days.

(21) Appl. No.: 12/474,558

(22) Filed: May 29, 2009

(65) Prior Publication Data

US 2009/0302733 A1 Dec. 10, 2009

(30) Foreign Application Priority Data

Jun. 4, 2008 (JP) ..... 2008-146358
Apr. 17, 2009 (JP) ..... 2009-100484

(51) Int. Cl.
*H01T 13/20* (2006.01)

(52) U.S. Cl. ..... 313/141

(58) Field of Classification Search ..... None
See application file for complete search history.

(56) References Cited

U.S. PATENT DOCUMENTS

| | | | | |
|---|---|---|---|---|
| 5,612,586 | A * | 3/1997 | Benedikt et al. | 313/141 |
| 6,724,132 | B2 * | 4/2004 | Kanao | 313/141 |
| 7,663,296 | B2 | 2/2010 | Kunitomo et al. | 313/141 |

FOREIGN PATENT DOCUMENTS

| | | |
|---|---|---|
| JP | 51-95541 | 8/1976 |
| JP | 6-140124 | 5/1994 |
| JP | 7022157 | 1/1995 |
| JP | 3273215 | 4/2002 |
| JP | 2002-324650 | 11/2002 |
| JP | 2005-93220 | 4/2005 |
| JP | 2007-294412 | 11/2007 |

OTHER PUBLICATIONS

Machine translation JP 1994-140124 A.*
Machine translation JP 1996-022884.*
Notification of Reasons for Refusal (mailed on Jan. 18, 2011) issued in connection with corresponding Japanese Patent Application No. 2009-100484, with English translation, 7 pages total.

* cited by examiner

*Primary Examiner* — Toan Ton
*Assistant Examiner* — Britt D Hanley
(74) *Attorney, Agent, or Firm* — Kusner & Jaffe

(57) ABSTRACT

A spark plug having a center electrode; an insulator having an axial hole extending in the direction of an axis; a metallic shell; a ground electrode extending from a front end portion of the metallic shell; a center-electrode-side noble metal chip joined to a distal end surface of the center electrode; and a ground-electrode-side noble metal chip joined to a distal end surface of the ground electrode, the ground-electrode-side noble metal chip having a distal end surface facing toward a side surface portion of the center-electrode-side noble metal chip, and the ground electrode being bent at an angle that falls within a range of 120° to 140° inclusive.

5 Claims, 7 Drawing Sheets

(a)

(b)

SPARK PLUG FOR INTERNAL COMBUSTION ENGINE

FIELD OF THE INVENTION

The present invention relates to a spark plug for an internal combustion engine and to a method of manufacturing the same.

BACKGROUND OF THE INVENTION

A spark plug for an internal combustion engine, such as automotive engine, includes, for example, a center electrode extending in an axial direction; an insulator provided radially outward of the center electrode; a tubular metallic shell provided radially outward of the insulator; and a ground electrode whose proximal end portion is joined to a front end portion of the metallic shell. The ground electrode is bent such that its distal end portion faces a distal end portion of the center electrode, whereby a spark discharge gap is formed between the distal end portion of the center electrode and the distal end portion of the ground electrode. In recent years, some spark plugs are designed in such a manner that chips, which are excellent in durability (spark ablation resistance), are provided at the distal end portion of the center electrode and the distal end portion of the ground electrode. An example of such a chip is a chip formed of a noble metal alloy (noble metal chip). Notably, in the case where the above-mentioned chip is joined to the distal end portions of the two electrodes, a spark discharge gap is formed between the two chips.

Incidentally, in addition to the position where the spark discharge gap is formed, the direction in which a spark is discharged can be changed by changing the relative position of the noble metal chip provided on the ground electrode (ground-electrode-side noble metal chip) in relation to the noble metal chip provided on the center electrode (center-electrode-side noble metal chip). Conventionally, a so-called longitudinal-discharge-type plug is known. In this plug, in order to improve ignitability, the ground electrode is bent such that the distal end surface of the ground-electrode-side noble metal chip faces the distal end surface of the center-electrode-side noble metal chip, and spark discharge occurs approximately along the axial direction. For example, see Japanese Patent Application Laid-Open (kokai) No. 2005-93220. However, a plug of such a type is disposed in such a manner that its ground electrode projects toward the center of a combustion chamber of an internal combustion engine. Therefore, when the internal combustion engine is operated, the ground electrode and the ground-electrode-side noble metal chip are disposed in an atmosphere of higher temperature, whereby the durability of the plug may lower.

In order to overcome the above-described drawback, a so-called lateral-discharge-type plug has been proposed. For example, see Japanese Patent No. 3273215. In this plug, in order to reduce the projection amount of the ground electrode, the ground electrode is bent in such a manner that the distal end surface of the ground-electrode-side noble metal chip faces a side surface portion of the center-electrode-side noble metal chip, and spark discharge occurs along a direction approximately perpendicular to the axis. In general, the clearance between the insulator and the ground electrode must be rendered relatively large in order to prevent discharge between the insulator and the ground electrode which discharge would otherwise occur, for example, when electrically conductive carbon adheres thereto. In the lateral-discharge-type plug, in order to secure the clearance, in general, the ground electrode is bent at an approximately right angle with a relatively small radius of curvature. Therefore, stress attributable to, for example, vibration generated as a result of operation of the internal combustion engine is likely to be concentrated on the bent portion of the ground electrode, which may result in breakage of the bent portion. In particular, in recent high output engines, spark plugs are more likely to suffer breakage of the ground electrode at the bent portion.

In view of the above-described problem, a so-called skew-discharge-type plug has been proposed. See, for example, Japanese Patent Application Laid-Open (kokai) No. 2002-324650. In this plug, the ground electrode is bent at a relatively obtuse angle in such a manner that an edge portion of the distal end of the ground-electrode-side noble metal chip is opposed to the distal end surface of the center-electrode-side noble metal chip, and spark discharge occurs along a skewed direction in relation to the axial direction.

However, in such a plug, spark discharge intensively abrades the edge portion of the distal end of the ground-electrode-side noble metal chip, so that the size of the spark discharge gap increases rapidly. Once the size of the spark discharge gap has increased, anomalous spark discharge becomes likely to occur between the ground electrode and the insulator or the like, which may bring about malfunctions such as deterioration in ignitability.

The present invention has been accomplished in view of the above-described problems. It is an object of the present invention to provide a spark plug for an internal combustion engine which can more reliably prevent occurrence of malfunctions, such as deterioration in ignitability, and which has excellent durability and resistance to breakage, as well as a method of manufacturing the same.

SUMMARY OF THE INVENTION

Hereinbelow, configurations suitable for achieving the above-described object will be described in an itemized fashion. Notably, when necessary, action and effects peculiar to each configuration (embodiment) will be added.

Configuration 1. A spark plug for an internal combustion engine according to the present configuration comprises:

- a rod-like center electrode;
- a tubular insulator having an axial hole extending along the direction of an axis of the center electrode, the center electrode being disposed in the axial hole;
- a tubular metallic shell provided radially outward of the insulator;
- a ground electrode extending from a front end portion of the metallic shell and bent such that a distal end of the ground electrode is directed toward the axis;
- a center-electrode-side chip joined to a distal end of the center electrode and extending along the direction of the axis; and
- a ground-electrode-side chip joined to a distal end surface of the ground electrode and having a distal end surface which faces a side surface portion of the center-electrode-side chip, wherein
- an angle θ formed between a first straight line and a second straight line falls within a range of 120° to 140° inclusive, the first straight line passing through the center of a proximal end surface of the ground electrode which borders on the front end portion of the metallic shell and the center of a cross section of the ground electrode at a position separated from the center of the proximal end surface toward the distal end by 0.5 mm as measured along the direction of the axis, and the second straight line passing through the center of a distal end surface of the ground electrode and the center of a cross section of the ground electrode at a position separated from the center of the distal end surface of the ground electrode toward the proximal end portion of the ground electrode by 0.5 mm as measured along a direction perpendicular to the axis; and an angle θ2 formed between the axis and a plane including the distal end surface of the ground-electrode-side chip falls within a range of 0° to 3° inclusive.

Notably, the ground-electrode-side chip may be joined indirectly to the distal end surface of the ground electrode via a pedestal portion formed of metal (e.g., Ni alloy). Further, the "center-electrode-side chip" and the "ground-electrode-side chip" are members which are more resistant to spark abrasion than base materials (the center electrode and the ground electrode) to which the chips are joined, and may be formed of a known noble metal material.

According to the above-described Configuration 1, the center-electrode-side chip is joined to the distal end surface of the center electrode, and the ground-electrode-side chip is joined to the distal end surface of the ground electrode. Therefore, durability (resistance to spark abrasion) can be improved.

In addition, the distal end surface of the ground-electrode-side chip is disposed to face the side surface portion of the center-electrode-side chip, so that spark discharge occurs along a direction approximately perpendicular to the axis. This configuration reduces the amount of the ground electrode that projects toward the center of a combustion chamber, to thereby improve the durability of the ground electrode and the ground-electrode-side chip.

Moreover, according to the present Configuration 1, the angle (bent angle) θ1 formed between the first straight line extending in the direction of the axis (hereinafter referred to as the "axial direction") and the second straight line falls within a range of 120° to 140° inclusive. That is, the ground electrode is bent toward the axis (the center electrode) at a relatively obtuse angle. Therefore, concentration of stress at the bent portion due to vibration or the like can be prevented more reliably, whereby breakage resistance can be improved.

In addition, the angle θ2 formed between the axis and a plane that includes the distal end surface of the ground-electrode-side chip falls within a range of 0° to 3° inclusive. That is, the two chips are disposed in such a manner that the distal end surface of the ground-electrode-side chip and the side surface portion of the center-electrode-side chip become approximately parallel with each other. Therefore, the ground-electrode-side chip and the center-electrode-side chip can be more reliably prevented from being unevenly abraded by means of spark discharge, whereby a rapid increase in the size of the spark discharge gap can be suppressed. As a result, malfunctions, such as anomalous spark discharge and misfire stemming from the expended spark discharge gap, can be suppressed more effectively.

Notably, when the angle θ1 formed between the first straight line and the second straight line is smaller than 120°, stress attributable to vibration or the like becomes likely to be concentrated at the bent portion of the ground electrode. Therefore, there is a possibility that the breakage resistance cannot be improved sufficiently. Meanwhile, when the angle θ1 formed between the first straight line and the second straight line is greater than 140°, the clearance between the ground electrode and the insulator becomes relatively small. Therefore, there is a possibility that anomalous spark discharge becomes more likely to occur.

Further, when the angle θ2 formed between the axis and the distal end surface of the ground-electrode-side chip exceeds 3°, local or uneven abrasion occurs on the ground-electrode-side chip and the center-electrode-side chip. Therefore, malfunctions, such as deterioration in ignitability, may occur.

Notably, the present configuration may be modified in such a manner that the center-electrode-side chip and the ground-electrode-side chip have relatively small diameters (e.g., ϕ0.3 mm to ϕ0.8 mm), and are joined to the corresponding electrodes in such a fashion that they project from the corresponding electrodes. In this case, heat of the flame kernel can be prevented from being released via the electrodes and the chips, whereby ignitability can be improved.

Configuration 2. A spark plug for an internal combustion engine according to the above-described Configuration 1 is further characterized in that an angle ϕ3 formed between the axis and a plane including the distal end surface of the ground electrode falls within a range of 0° to 1° inclusive.

According to the above-described Configuration 2, the angle θ3 formed between the axis and a plane that includes the distal end surface of the ground electrode falls within a range of 0° to 1° inclusive. In other words, the side surface portion of the center-electrode-side chip becomes approximately parallel with a portion of the ground electrode to which the ground-electrode-side chip is joined. Therefore, in the case where a cylindrical columnar ground-electrode-side chip is welded to the distal end surface of the ground electrode, even when the welding produces a slight relative inclination (e.g., about 1°) between the distal end surface of the ground-electrode-side chip and the distal end surface of the ground electrode, the angle θ2 formed between the axis (the side surface portion of the center-electrode-side chip) and the plane containing the distal end surface of the ground-electrode-side chip can be rendered to fall within the range of 0° to 3° inclusive, by means of a simple correction step performed manually or by use of an automatic machine. That is, according to the present Configuration 2, without performing any special step, the above-described Configuration 1 can be realized relatively easily by merely welding a cylindrical columnar ground-electrode-side chip to the distal end surface of the ground electrode.

Configuration 3. A spark plug for an internal combustion engine according to the above-described Configurations 1 or 2 is further characterized in that the center-electrode-side chip is joined to the center electrode via a weld portion formed by means of fusing together a material which constitutes the center-electrode-side chip and a material which constitutes the center electrode; and a distance between the distal end surface of the ground-electrode-side chip and the weld portion as measured along the axial direction is at least 0.6 mm.

In general, the center electrode and the center-electrode-side chip are joined together through a process of fusing together the metallic materials of the center electrode and the center-electrode-side chip by means of laser welding or the like, to thereby form a weld portion. In order to improve ignitability, a center-electrode-side chip which is relatively small in diameter can be used as described above. In such a case, the weld portion, which serves a joint portion between the center electrode and the center-electrode-side chip, may be formed to have a diameter greater than that of the center-electrode-side chip. If the weld portion is formed to be relatively large in diameter, the clearance between the weld portion and the ground-electrode-side chip becomes relatively small. Therefore, anomalous spark discharge is likely to occur between the weld portion and the ground-electrode-side chip, whereby ignitability may deteriorate.

In contrast, according to the above-described Configuration 3, the distance between the ground-electrode-side chip and the weld portion as measured along the axial direction is at least 0.6 mm, which is relatively large. Accordingly, occurrence of anomalous spark discharge between the ground-electrode-side chip and the weld portion can be suppressed effectively, and deterioration in ignitability can be prevented more reliably.

Notably, deterioration in ignitability can be prevented with further reliability by means of increasing the distance between the ground-electrode-side chip and the weld portion along the axial direction. However, in such a case, the ground electrode and the center electrode are disposed to project toward the center of a combustion chamber, so that the two electrodes may suffer deterioration in durability. Accordingly, preferably, the distance between the ground-electrode-side chip and the weld portion along the axial direction is increased to such a degree that the durability of the two electrodes does not lower.

Configuration 4. A spark plug for an internal combustion engine according to any one of the above-described Configurations 1 to 3 is further characterized in that a distance between a front end of an inner circumferential surface of the metallic shell and the distal end surface of the ground electrode as measured along a direction perpendicular to the axis is 1.5 mm or less.

Notably, in the case where the distal end surface of the ground electrode slants in relation to the axis, the "distance between the front end of the inner circumferential surface of the metallic shell and the distal end surface of the ground electrode" refers to the "distance between the front end of the inner circumferential surface of the metallic shell and the center of the distal end surface of the ground electrode" (this convention also applies to the following description).

When the ground electrode is bent in such a manner that, as in the above-described Configuration 4, the distance between the inner circumferential surface of the metallic shell and the distal end surface of the ground electrode as measured along a direction perpendicular to the axis becomes relatively short; i.e., 1.5 mm or less, the ground electrode must be bent relatively tightly (in other words, at a relatively small radius of curvature) in order to prevent the ground electrode from being excessively close to the insulator. However, in such a case, stress is more likely to concentrate at the bent portion of the ground electrode, so that breakage resistance may drop (i.e., fatigue failure is more likely).

In contrast, by means of bending the ground electrode at a relatively obtuse angle as described above, the concentration of stress at the bent portion of the ground electrode can be suppressed even when the radius of curvature of the ground electrode must be made relatively small as in the present Configuration 4. Thus, deterioration in breakage resistance can be prevented effectively. In other words, employment of the above-described Configuration 1, etc., is particularly beneficial in the case where the ground electrode is bent in such a manner that the distance between the front end of the inner circumferential surface of the metallic shell and the distal end surface of the ground electrode as measured along a direction perpendicular to the axis becomes relatively small (for example, the case where the metallic shell has a relatively small diameter).

Configuration 5. A spark plug for an internal combustion engine according to any one of the above-described Configurations 1 to 4 is further characterized in that a distance between a front end of an inner circumferential surface of the metallic shell and the distal end surface of the ground electrode as measured along a direction perpendicular to the axis is 0.9 mm or less.

When the ground electrode is bent in such a manner that, as in the above-described Configuration 5, the distance between the front end of the inner circumferential surface of the metallic shell and the distal end surface of the ground electrode as measured along a direction perpendicular to the axis becomes shorter; i.e., 0.9 mm or less, the radius of curvature of the bent portion must be reduced further. Accordingly, concentration of stress at the bent portion of the ground electrode becomes more likely to occur. However, through employment of the above-described Configuration 1, etc., concentration of stress at the bent portion of the ground electrode can be restrained, whereby deterioration in breakage resistance can be prevented more reliably.

Preferably, a manufacturing method of Configuration 6, which will be described below, is used so as to manufacture the spark plug described in the above-described Configurations 1 to 5.

Configuration 6. A method of manufacturing a spark plug described in any one of the above-described Configurations 1 to 5 comprises:

- a bending step of bending the ground electrode fixed to the front end portion of the metallic shell;
- a cutting step of cutting a distal end portion of the ground electrode;
- a welding step of welding the ground-electrode-side chip to a cut surface of the ground electrode; and
- an assembling step of fixing the insulator to the metallic shell in a state in which the insulator holding the center electrode is inserted into the metallic shell, wherein
- in the cutting step, the distal end portion of the ground electrode is cut in such a manner that the cut surface of the ground electrode extends perpendicularly to an extending direction of the ground electrode as viewed from a front end side with respect to the axial direction, and the cut surface becomes approximately flat.

In general, the ground electrode is bent after the metallic shell and the insulator holding the center electrode are assembled together (see, for example, Japanese Patent No. 3389121), because a worker can readily adjust the size of the spark discharge gap formed between the center electrode and the ground electrode, while viewing the spark discharge gap. However, in the case of a spark plug in which a ground-electrode-side chip is provided on the distal end surface of the ground electrode bent at an obtuse angle of 120° to 140° as the spark plug according to any one of the above-described configurations, the following problem may occur when the conventional manufacturing method is employed.

When the conventional method (i.e., a method in which the ground electrode is bent after the metallic shell and the insulator holding the center electrode are assembled together, and the spark discharge gap is adjusted to have a proper size) is employed for the spark plug having the above-described configuration, the ground-electrode-side chip must be joined to the ground electrode before the ground electrode is bent. Since the ground electrode is bent at the above-described predetermined obtuse angle, an inclined surface must be formed at the distal end of the ground electrode in advance, and the ground-electrode-side chip joined to the inclined surface. Notably, this inclined surface corresponds to the distal end surface of the ground electrode in the present invention. In a state where the chip is joined to the ground electrode, the ground electrode is bent to have the above-described predetermined obtuse angle. Since the chip is present at the distal end of the ground electrode, the chip interferes with a press jig used to bend the ground electrode. Therefore, in some cases, a sufficient bent angle cannot be obtained, or the discharge surface (distal end surface) of the chip is damaged and discharge is hindered.

In view of this, according to the above-described Configuration 6, the ground electrode is first fixed to the front end portion of the metallic shell, and then the ground electrode is bent. However, at this point in time, the ground-electrode-side chip has not yet been joined to the distal end of the ground electrode. Therefore, the above-described problems, such as failure to obtain the above-mentioned sufficient bent angle, do not occur at the time of bending of the ground electrode.

Further, according to the present Configuration 6, during the cutting step performed after the ground electrode is bent, a flat surface is formed at the distal end of the ground electrode so as to allow proper welding of a chip to the distal end. Accordingly, previous formation of an inclined surface at the distal end of the ground electrode is unnecessary, and the cylindrical columnar chip joined to the distal end surface (cut surface) can be prevented from inclining excessively in relation to the center-electrode-side chip. In addition, since the chip is joined after the ground electrode is bent, a change in the size of the spark discharge gap stemming from a small change in the bent angle can be prevented. Therefore, according to the present Configuration 6, the spark plug described in the above-described Configuration 1, etc., which is relatively difficult to manufacture in accordance with the conventional method, can be manufactured relatively easily and accurately.

Configuration 7. A method of manufacturing a spark plug according to the above-described Configuration 6 is further characterized in that, in the cutting step, cutting means having a cutting portion along a periphery thereof is moved along a center axis of the metallic shell so as to cut the distal end portion of the ground electrode.

According to the above-described Configuration 7, basically, actions and effects similar to those attained by the above-described Configuration 6 can be attained. In addition, when a tool, such as a punching tool, which can be passed through the metallic shell is used as the cutting means, an accident in which the cutting means comes into contact with the metallic shell and damages the metallic shell can be prevented more reliably.

Configuration 8. A method of manufacturing a spark plug according to the above-described Configuration 6 is further characterized in that, in the cutting step, cutting means having a cutting portion along a periphery thereof is moved along a direction perpendicular to a center axis of the metallic shell so as to cut the distal end portion of the ground electrode.

According to the above-described Configuration 8, basically, actions and effects similar to those attained by the above-described Configuration 6 can be attained. In addition, according to the present Configuration 8, in the cutting step, the cutting means, such a cutting blade, does not approach the metallic shell along the axial direction, and a clearance greater than a predetermined size is formed between the cutting means and the metallic shell. Therefore, contact of the cutting means with the metallic shell can be prevented, and thus damage to the metallic shell can be prevented more reliably.

DETAILED DESCRIPTION OF PREFERRED EMBODIMENTS

Figure 1:
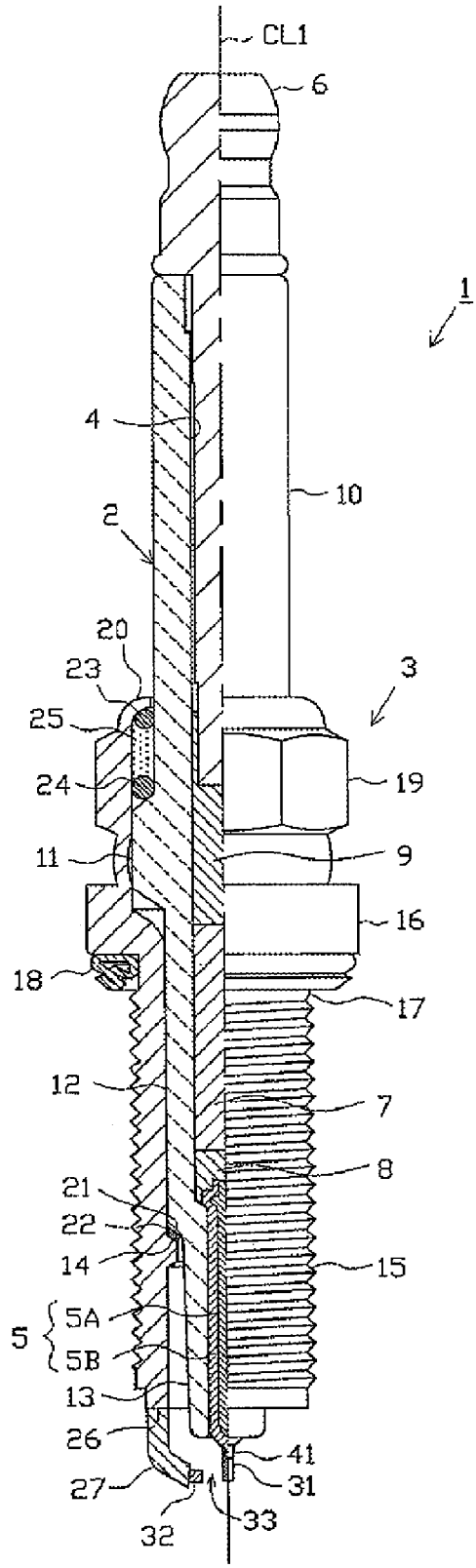
FIG. 1 is a partially-sectioned, front view showing the configuration of a spark plug according to a first embodiment.

One embodiment will now be described with reference to the drawings. FIG. 1 is a partially sectioned front view of a spark plug for an internal combustion engine (hereinafter, "spark plug") 1. Notably, in FIG. 1, the spark plug 1 is depicted in such a manner that the direction of an axis CL1 which passes through the center of the spark plug 1 with respect to the radial direction coincides with the vertical direction in FIG. 1. Further, in the following description, the lower side of FIG. 1 will be referred to as the front end side of the spark plug 1, and the upper side of FIG. 1 will be referred to as the rear end side of the spark plug 1.

The spark plug 1 is composed of a tubular insulator 2, and a tubular metallic shell 3 which holds the insulator 2.

As well known, the insulator 2 is formed from alumina or the like through firing. The insulator 2 includes a rear-end-side trunk portion 10 formed on the rear end side; a larger diameter portion 11 projecting radially outward on the front end side of the rear-end-side trunk portion 10; and an intermediate trunk portion 12 formed on the front end side of the larger diameter portion 11 and having a diameter smaller than that of the larger diameter portion 11. The insulator 2 includes a leg portion 13 formed on the front end side of the intermediate trunk portion 12. The leg portion 13 is tapered such that the diameter decreases toward the front end side with respect to the direction of the axis CL1. Of the insulator 2, the larger diameter portion 11, the intermediate trunk portion 12, and the greater part of the leg portion 13 are accommodated within the metallic shell 3. A tapered step portion 14 is formed at a connection portion between the leg portion 13 and the intermediate trunk portion 12. The insulator 2 is engaged with the metallic shell 3 at a stepped portion 14.

Further, the insulator 2 has an axial hole 4 which extends through the insulator 2 along the axis CL1. The center electrode 5 is inserted into and fixed to a front end portion of the axial hole 4. The center electrode 5 assumes a rod-like shape (cylindrical columnar shape) as a whole, and its center axis coincides with the axis CL1. In addition, the distal end surface of the center electrode 5 is formed flat, and projects from the distal end of the insulator 2. Further, the center electrode 5 includes an inner layer 5A formed of copper or a copper alloy, and an outer layer 5B formed of a Ni alloy whose predominant component is nickel (Ni).

Further, a center-electrode-side noble metal chip 31, which is formed of a predetermined noble metal alloy and serves as a center-electrode-side chip, is joined to a distal end portion of the center electrode 5. More specifically, the center-electrode-side noble metal chip 31 is joined as a result of a weld portion 41 being formed along the periphery of an interface between the outer layer 5A and the center-electrode-side noble metal chip 31 by means of laser welding or the like. Further, in the present embodiment, the center-electrode-side noble metal chip 31 assumes a cylindrical columnar shape and has a diameter (e.g., ϕ0.3 mm to ϕ0.7 mm) that is smaller than that the diameter of the distal end surface of the center electrode 5. Therefore, of the weld portion 41 formed by fusing together the distal end portion of the center electrode 5 (outer layer 5B) and the center-electrode-side noble metal chip 31, a proximal end portion thereof is greater in diameter than the center-electrode-side noble metal chip 31 (see FIG. 2, etc.). In addition, the center-electrode-side noble metal chip 31 is relatively long, and is joined in such a manner that its distal end surface projects from the weld portion 41 by a relatively large amount.

Further, a terminal electrode 6 is inserted into and fixed to a rear end portion of the axial hole 4 in such a manner that the terminal electrode 6 projects from the rear end of the insulator 2.

Further, a cylindrical columnar resistor 7 is disposed in the axial hole 4 between the center electrode 5 and the terminal electrode 6. Opposite end portions of the resistor 7 are electrically connected to the center electrode 5 and the terminal electrode 6, respectively, via electrically conductive glass seal layers 8 and 9, respectively.

The metallic shell 3 is formed of metal such as low carbon steel and has a tubular shape. A thread portion (external thread portion) 15 for mounting the spark plug 1 onto an engine head is formed on the outer circumferential surface thereof. A seat portion 16 is formed on the outer circumferential surface located on the rear end side of the thread portion 15. A ring-shaped gasket 18 is fitted into a thread neck potion 17 at the rear end of the thread portion 15. A tool engagement portion 19 and a crimped portion 20 are provided at the rear end of the metallic shell 3. The tool engagement portion 19 has a hexagonal cross section. A tool, such as a wrench, engages with the tool engagement portion 19 when the metallic shell 3 is mounted to the engine head. The crimped portion 20 holds the insulator 2 at the rear end portion.

Further, a tapered step portion 21 with which the insulator 2 is engaged is provided on the inner circumferential surface of the metallic shell 3. The insulator 2 is inserted into the metallic shell 3 from its rear end side toward the front end side. In a state where the step portion 14 of the insulator 2 is engaged with the step portion 21 of the metallic shell 3, a rear-end-side opening portion of the metallic shell 3 is crimped radially inward; i.e., the above-mentioned crimped portion 20 is formed, whereby the insulator 2 is fixed. Notably, an annular plate packing 22 is interposed between the step portion 14 of the insulator 2 and the step portion 21 of the metallic shell 3. Thus, the airtightness of a combustion chamber is secured, whereby a fuel air mixture which enters the clearance between the inner circumferential surface of the metallic shell 3 and the leg portion 13 of the insulator 2 exposed to the interior of the combustion chamber is prevented from leaking to the outside.

Moreover, in order to render the sealing by the crimping more perfect, on the rear end side of the metallic shell 3, annular ring members 23 and 24 are interposed between the metallic shell 3 and the insulator 2, and powder of talc 25 is charged into the space between the ring members 23 and 24. That is, the metallic shell 3 holds the insulator 2 via the plate packing 22, the ring members 23 and 24, and the talc 25.

Figure 2:
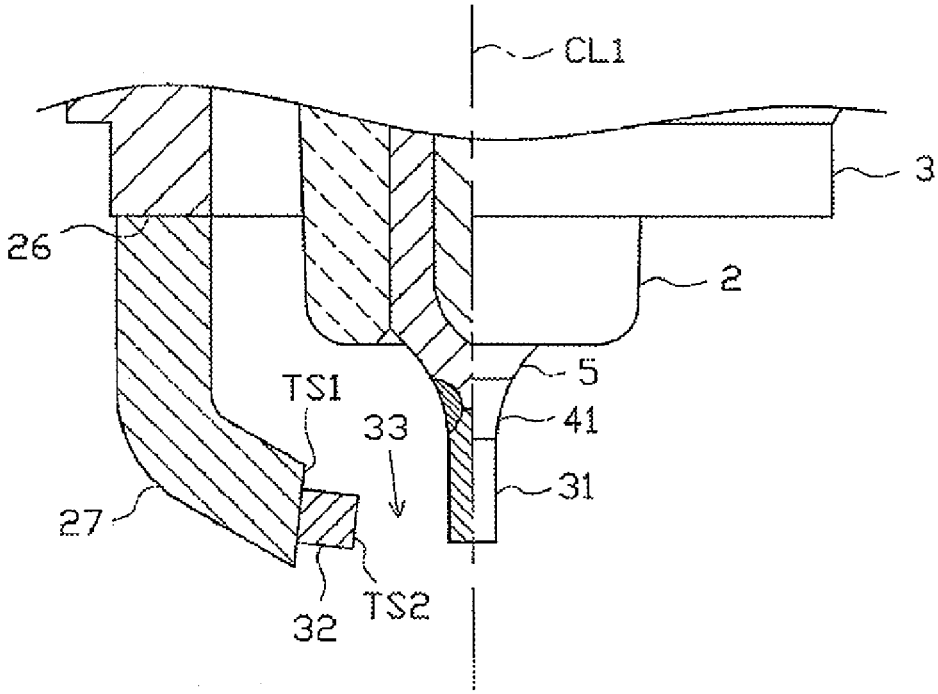
FIG. 2 is a partially-sectioned, enlarged view showing the configuration of a front end portion of the spark plug.

As shown in FIG. 2, a ground electrode 27 is joined to a front end portion 26 of the metallic shell 3. A front end portion of the ground electrode 27 is bent toward the center electrode 5 (axis CL1). A ground-electrode-side noble metal chip 32, which is formed of a noble metal alloy and serves as a ground-electrode-side chip, is joined to a distal end surface TS1 of the ground electrode 27, which surface is located at the distal end with respect to the extending direction of the ground electrode 27. The ground-electrode-side noble metal chip 32 assumes a cylindrical columnar shape and has a relatively small diameter (e.g., ϕ0.4 mm to ϕ0.8 mm). Notably, in the present embodiment, the ground-electrode-side noble metal chip 32 is joined in such a manner that its distal end surface TS2 projects a predetermined distance (e.g., 0.6 mm to 0.8 mm) from the distal end surface TS1 of the ground electrode. In addition, the greater part of the distal end surface TS2 of the ground-electrode-side noble metal chip 32 faces a side surface portion of the center-electrode-side noble metal chip 31, so that a spark discharge gap 33 is formed between the two chips 31 and 32, in which spark discharge occurs along a direction approximately perpendicular to the axis CL1.

Figure 3:
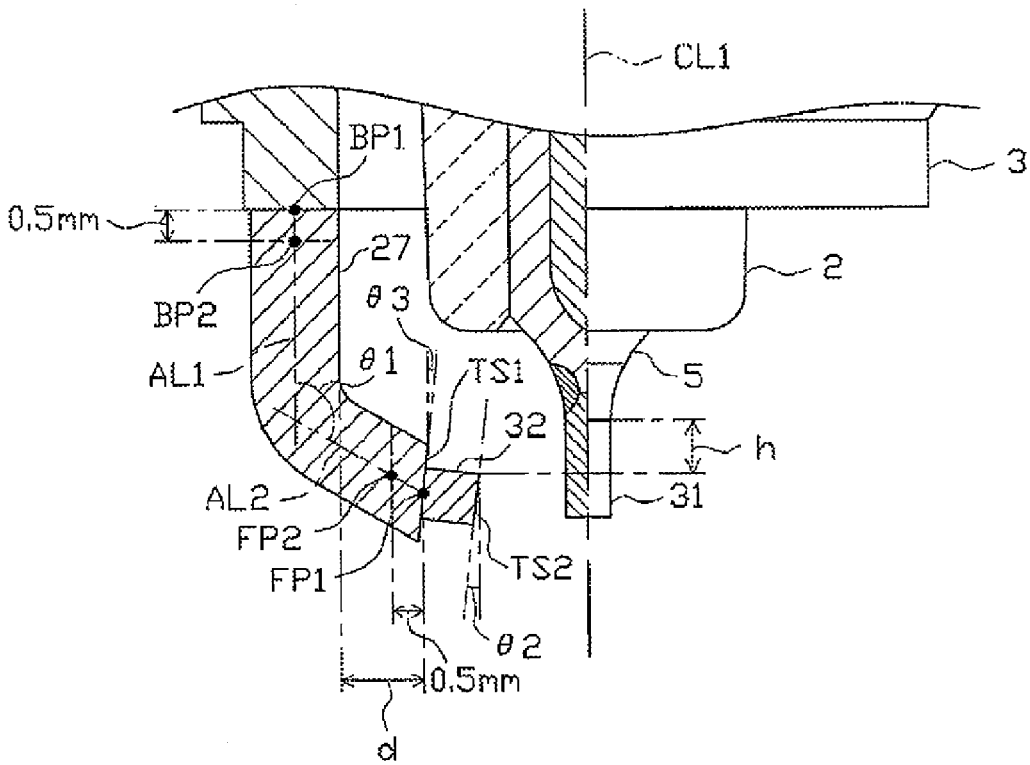
FIG. 3 is a partially-sectioned, enlarged view showing the configurations of a ground electrode, etc.

In addition, in the present embodiment, as shown in FIG. 3, the ground electrode 27 is bent in such a manner that an angle (bent angle) θ1, which is formed between a first straight line AL1 and a second straight line AL2, falls within a range of 120° to 140° inclusive. In other words, the ground electrode 27 is bent toward the axis CL1 at a relatively obtuse bent angle.

Notably, the "first straight line AL1" refers to a straight line which passes through the center BP1 of a surface (proximal end surface) of the ground electrode 27 which abuts the front end portion of the metallic shell 3 and the center BP2 of a cross section of the ground electrode 27 at a position separated from the center BP1 toward the distal end side by 0.5 mm as measured along the axis CL1. In the present embodiment, the first straight line AL1 extends in parallel with the axis CL1. Further, the "second straight line AL2" refers to a straight line which passes through the center FP1 of the distal end surface TS1 of the ground electrode 27 and the center FP2 of a cross section of the ground electrode 27 at a position separated from the center FP1 toward the proximal end portion of the ground electrode 27 by 0.5 mm as measured along a direction perpendicular to the axis CL1.

Further, an angle θ2, formed between the axis CL1 and a plane containing the distal end surface TS2 of the ground-electrode-side noble metal chip 32, falls within a range of 0° to 3° inclusive. That is, the distal end surface TS2 of the ground-electrode-side noble metal chip 32 and the side surface portion of the center-electrode-side noble metal chip 31 face each other approximately in parallel with each other.

Further, the angle θ3, formed between the axis CL1 and a plane including the distal end surface TS1 of the ground electrode 27, falls within a range of 0° to 1° inclusive. That is, in the present embodiment, the distal end surface TS1 of the ground electrode 27 is formed in such a manner that it becomes approximately parallel to the side surface portion of the center-electrode-side chip 31.

Moreover, the distance h between the distal end surface TS1 of the ground-electrode-side noble metal chip 32 and the weld portion 41 as measured along the axis CL1 is 0.6 mm or greater.

In addition, since the metallic shell 3 has a relatively small diameter, the ground electrode 27 is bent in such a manner that the distance d between the front end of the inner circumferential surface of the metallic shell 3 and the distal end surface TS1 of the ground electrode 27 as measured along a direction perpendicular to the axis CL1 becomes relatively small (e.g., 1.5 mm or less). In this respect, the ground electrode 27 is bent with a relatively small radius of curvature such that the clearance between the ground electrode 27 and the insulator 2 is greater than at least the spark discharge gap 33.

Notably, in the present embodiment, a projection length from the front end of the metallic shell 3 to the distal end of the center-electrode-side noble metal chip 31 as measured along the axis CL1 is approximately equal to a projection length of the ground electrode 27 from the front end of the metallic shell 3 as measured along the axis CL1 (e.g., the difference between the two projection lengths is 0.3 mm or less).

Next, a method of manufacturing the spark plug 1 configured as described above will be described. First, the metallic shell 3 is pre-fabricated. That is, cold forging operation is performed on a cylindrical columnar metal material (e.g., iron material or stainless steel material such as S17C or S25C) so as to form a through hole therein and impart a rough shape to the metal material. Subsequently, cutting operation is performed on the metal material so as to impart a predetermined outer shape to the metal material to thereby obtain a metallic shell intermediate.

Figure 4:
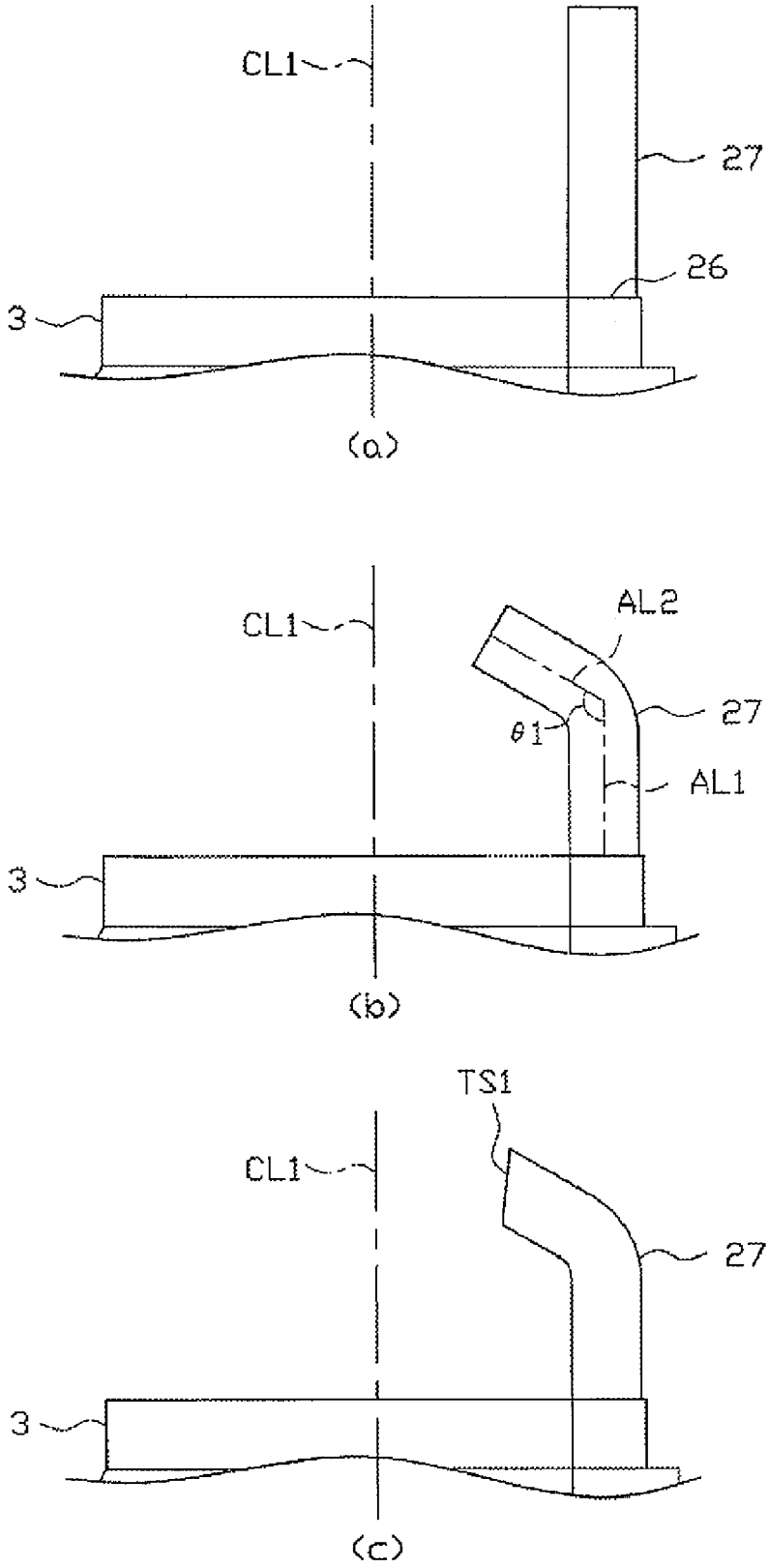
FIGS. 4(*a*) to (*c*) are enlarged front views used for explaining a method of manufacturing the spark plug.

Subsequently, the ground electrode 27 formed of a Ni alloy and having the form of a straight rod is resistance-welded to the front end surface of the metallic shell intermediate. Since a so-called "sag" is produced as a result of the welding, the "sag" is removed. Subsequently, the thread portion 15 is formed in a predetermined region of the metallic shell intermediate by means of form rolling. Thus, as shown in FIG. 4(*a*), the metallic shell 3 to which the ground electrode 27 has been welded is obtained. Zinc plating or nickel plating is performed on the metallic shell 3 to which the ground electrode 27 has been welded. Notably, in order to improve corrosion resistance, chromate treatment may be performed on the surface.

Figure 7:
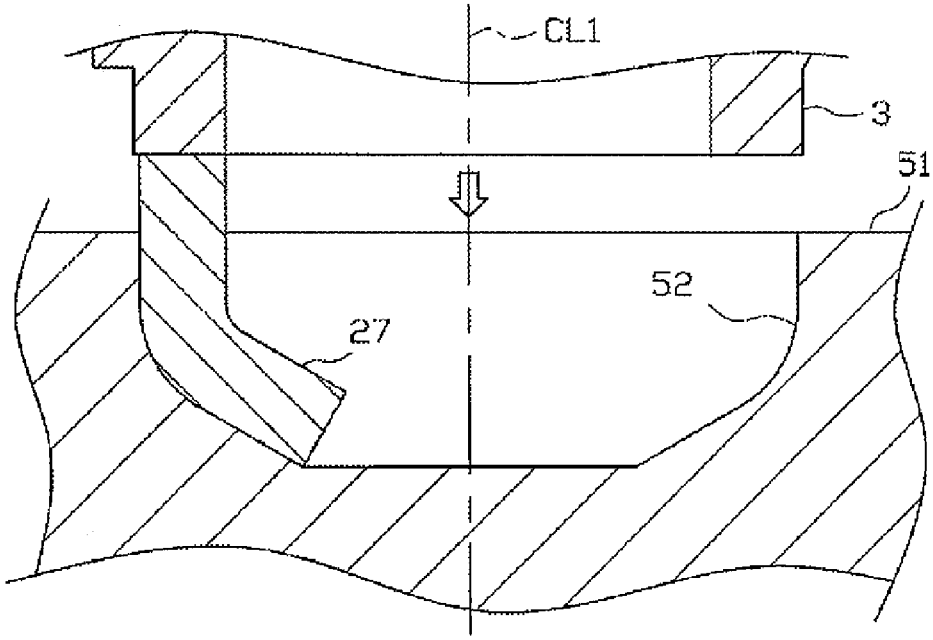
FIGS. 7(*a*) and (*b*) are enlarged sectional views showing a ground electrode and a bending die used during a bending step.
Figure 7:
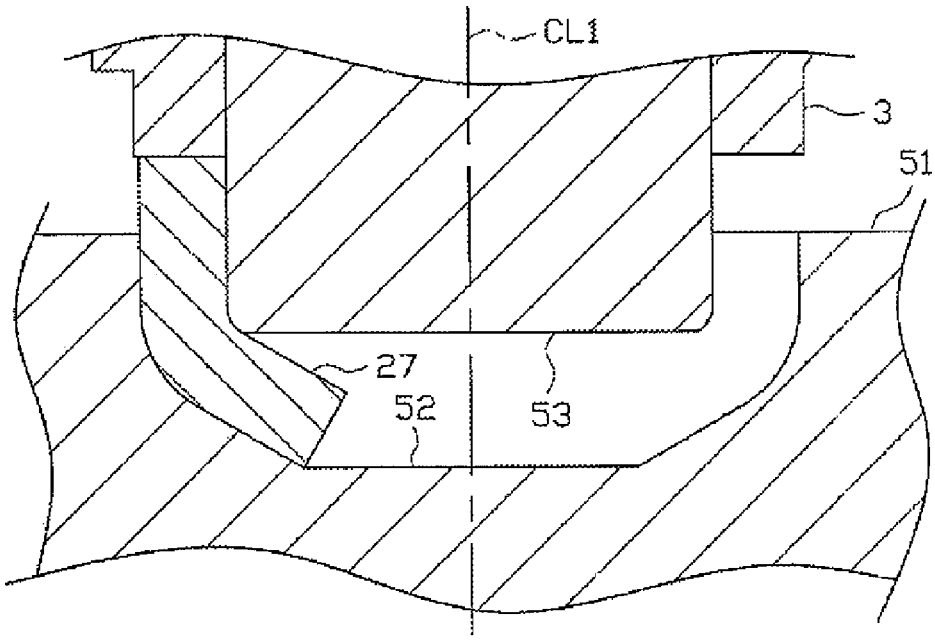

Next, in a bending step, as shown in FIG. 4(*b*), the ground electrode 27 is bent toward the axis CL1. At that time, although the ground electrode 27 is bent with a relatively small radius of curvature, the bent angle θ1 is relatively large (i.e., within a range of 120° to 140° inclusive). By way of example, a method as shown in FIG. 7(*a*), may be employed when the ground electrode 27 is bent. That is, the metallic shell 3 is caused to approach a bending die 51 having a forming surface 52 of a shape corresponding to the bent shape of the ground electrode 27, and the ground electrode 27 is pressed against the forming surface 52, whereby the ground electrode 27 is bent. Alternatively, a method shown in FIG. 7(*b*) may be employed. That is, a cylindrical columnar guide 53 is passed through the metallic shell 3, and is brought into contact with a proximal end portion of the ground electrode 27. In this state, the metallic shell 3 is caused to approach the bending die 51, whereby the ground electrode 27 is bent. In this case, leaning of the proximal end portion of the ground electrode 27 toward the axis CL1 can be prevented more reliably.

Figure 8:
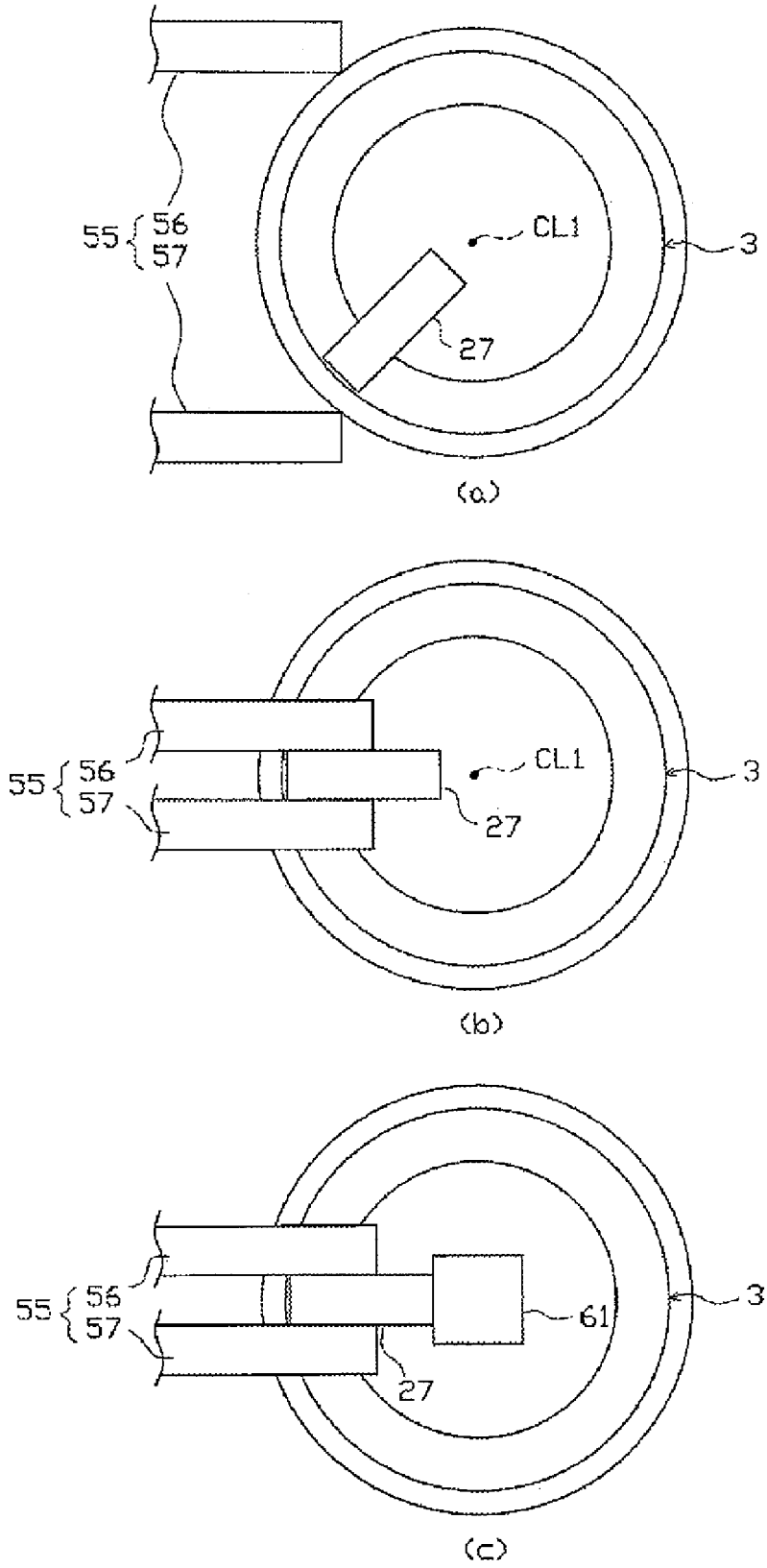
FIGS. 8(*a*) to (*c*) are schematic plan views showing the ground electrode, a guide, etc., used during a cutting step.

In a cutting step, the bent ground electrode 27 is positioned and held at a predetermined position, and a distal end portion of the ground electrode 27 is cut to form a flat distal end surface (cut surface) by use of a cutting blade 61, which serves as cutting means and which can be reciprocated along the direction of the axis CL1 in relation to the distal end portion of the ground electrode 27. Specifically, a punching operation is performed to cut the end of ground electrode 27. More specifically, the metallic shell 3 is held such that it can rotate about a center axis thereof (which coincides with the axis CL1). Next, as shown in FIG. 8(*a*), a guide 55 having a pair of nipping portions 56 and 57 is caused to move toward the ground electrode 27, and is disposed such that the ground electrode 27 is located between the nipping portions 56 and 57. Notably, the paired nipping portions 56 and 57 can move to approach and separate from each other, and their surfaces which face each other are in parallel with each other. Next, as shown in FIG. 8(*b*), the paired nipping portions 56 and 57 are caused to approach each other so as to nip, i.e., capture, a proximal end portion of the ground electrode 27 between the nipping portions 56 and 57. Thus, the ground electrode 27 is positioned at the predetermined position, and held by the nipping portions 56 and 57. Subsequently, as shown in FIG. 8(*c*), the cutting blade 61, which has a rectangular cross section and which has been passed through the metallic shell 3, is moved toward the ground electrode 27 along the axis CL1, whereby the distal end portion of the ground electrode 27 is cut. Notably, the cut surface of the ground electrode 27 extends perpendicularly to the extending direction of the ground electrode 27 as viewed from the front end side with respect to the direction of the axis CL1. Thus, as shown in FIG. 4(*c*), the distal end surface TS1 of the ground electrode 27 becomes approximately parallel with the axis CL1 (that is, the above-mentioned angle θ3 falls within a range of 0° to 1° inclusive).

After that, in a welding step, the cylindrical columnar ground-electrode-side noble metal chip 32 is joined to the distal end surface TS1 of the ground electrode 27 by means of resistance welding. Notably, at the time of above-described punching operation, the cut surface of the ground electrode is made flat. Therefore, the ground-electrode-side noble metal chip 32 can be readily joined to the distal end surface TS1.

Meanwhile, the insulator 2 is formed separately from the metallic shell 3. For example, material granules for molding are prepared from material powder containing alumina (predominant component), binder, etc. A cylindrical compact is obtained by performing rubber press molding while using the material granules. Grinding is performed on the obtained compact for trimming. The trimmed compact is placed in a firing furnace and fired, whereby the insulator 2 is obtained.

Further, separately from the metallic shell 3 and the insulator 2, the center electrode 5 is manufactured. That is, a Ni alloy is forged, and the inner layer 5A formed of a copper alloy is placed at a center portion thereof in order to improve heat radiation performance. Next, the center-electrode-side noble metal chip 31 is attached to the distal end portion of the center electrode 5 by means of laser welding. More specifically, the distal end surface of the outer layer 5B and the proximal end surface of the cylindrical columnar center-electrode-side noble metal chip 31 are aligned and caused to abut against each other, and the outer periphery of the interface between the outer layer 5B and the noble metal chip 31 is irradiated with a laser beam so as to form the weld portion 41, whereby the center-electrode-side noble metal chip 31 is joined to the distal end portion of the center electrode 5.

The insulator 2 and the center electrode 5 obtained in the above-described manner, the resistor 7, and the terminal electrode 6 are sealed and fixed together by means of the glass seal layers 8 and 9. In general, the glass seal layers 8 and 9 are formed of a mixture of borosilicate glass and metal powder. The mixture is charged into the axial hole 4 of the insulator 2 in such a manner that the resistor 7 is disposed between upper and lower layers of the mixture. While the assembly is heated within the firing furnace, the mixture is pressed from the rear side via the terminal electrode 6, whereby the mixture is densified and fired. Notably, at that time, a layer of graze may be simultaneously formed on the surface of the rear-end-side trunk portion 10 of the insulator 2 through firing. Alternatively, the layer of graze may be formed in advanced.

After that, in an assembling step, the insulator 2 manufactured as described above and including the center electrode 5 and the terminal electrode 6, and the metallic shell 3 manufactured as described above and having the ground electrode 27 are assembled together. More specifically, the insulator 2 is fixed by crimping radially inward the rear-end-side opening portion of the metallic shell 3, which portion is relatively thin; i.e., by forming the above-mentioned crimped portion 20.

Finally, the spark discharge gap 33 between the center-electrode-side noble metal chip 31 and the ground-electrode-side noble metal chip 32 is finely adjusted, whereby the spark plug 1 is obtained.

As having been described in detail, according to the present embodiment, the center-electrode-side noble metal chip 31 is joined to the distal end portion of the center electrode 5, and the ground-electrode-side noble metal chip 32 is joined to the distal end surface TS1 of the ground electrode 27. Therefore, durability (resistance to spark abrasion) can be improved. Further, the two noble metal chips 31 and 32 are relatively small in diameter, and joined in such a fashion that they project from the corresponding electrodes 5 and 27, respectively. Therefore, heat of the fire kernel is prevented from escaping via the electrodes 5 and 27 and the noble metal chip 31 and 32, whereby ignitability can be improved.

In addition, the distal end surface TS2 of the ground-electrode-side noble metal chip 32 is disposed to face the side surface portion of the center-electrode-side noble metal chip 31, so that discharge occurs along a direction approximately perpendicular to the axis CL1. Thus, the amount of projection of the ground electrode 27 toward the center of a combustion chamber can be made relatively small, whereby the durability of the round electrode 27 and the ground-electrode-side noble metal chip 32 can be improved.

Moreover, the ground electrode 27 is bent at a relatively large bent angle in such a manner that the angle θ1 formed between the first straight line AL1 and the second straight line AL2 falls within a range of 120° to 140° inclusive. Therefore, concentration of stress at the bent portion due to vibration or the like can be prevented, and breakage resistance can be improved.

Further, since the ground electrode 27 is bent at a relatively large bent angle, even in the case where the radius of curvature of the ground electrode 27 must be made relatively small as in the present embodiment, concentration of stress at the bent portion of the ground electrode 27 can be suppressed, and deterioration in breakage resistance can be prevented effectively.

Additionally, since the angle θ2 formed between the axis CL1 and a plane including the distal end surface TS2 of the ground-electrode-side noble metal chip 32 falls within a range of 0° to 3° inclusive, uneven or local abrasion of the ground-electrode-side noble metal chip 32 and the center-electrode-side noble metal chip 31 caused by spark discharge can be prevented more reliably. As a result, rapid widening of the spark discharge gap 33 can be suppressed, whereby malfunctions, such as anomalous spark discharge and misfire stemming from the widened spark discharge gap 33, can be suppressed more effectively.

Further, the angle θ3 formed between the axis CL1 and a plane including the distal end surface TS2 of the ground electrode 27 falls within a range of 0° to 1° inclusive. Therefore, in the case where the cylindrical columnar ground-electrode-side chip 32 is welded to the distal end surface TS2 of the ground electrode 27, even when the welding produces a slight relative inclination (e.g., about 1°) between the distal end surface TS2 of the ground-electrode-side chip 32 and the distal end surface TS1 of the ground electrode 27, the angle θ2 formed between the axis CL1 and the plane containing the distal end surface TS2 of the ground-electrode-side chip 32 can be rendered to fall within the range of 0° to 3° inclusive. That is, without performing any special step; i.e., by merely welding the ground-electrode-side chip 32 to the distal end surface TS2 of the ground electrode 27, the distal end surface TS2 of the ground-electrode-side chip 32 and the side surface portion of the center-electrode-side noble metal chip 31 can be made approximately parallel with each other.

Incidentally, resistance-welding the ground-electrode-side noble metal chip 32 to a ground electrode 27 that has a plating layer formed on the surface thereof is relatively difficult. Further, when the ground electrode 27 having a plating layer is bent, the plating layer exfoliates. In such a case, spark discharge may occur between the center electrode 5 and an exfoliated portion of the plating layer, whereby ignitability deteriorates. Therefore, in general, a process of removing the plating layer from a predetermined area of the ground electrode 27 (for example, a portion to which the ground-electrode-side noble metal chip 32 is to be welded, and a portion at which the ground electrode 27 is to be bent) is performed.

According to the present embodiment, since a punching operation is performed for forming the distal end portion of the ground electrode 27, the ground-electrode-side noble metal chip 32 can be joined to the distal end surface TS1 of the ground electrode 27 by means of resistance welding, without separately performing a process of removing the plating layer. Further, since the bent angle θ1 of the ground electrode 27 is relatively large, even if a plating layer is formed on a portion at which the ground electrode 27 is to be bent (the plating layer is not removed), exfoliation of the plating layer due to bending is less likely to occur. That is, through employment of the shape of the ground electrode 27 and the manufacturing method according to the present embodiment, the process of removing the plating layer formed on the surface of the ground electrode 27 can be eliminated, whereby production efficiency can be improved.

Moreover, when the spark plug 1 is manufactured, the ground electrode 27 is bent in a stage before the assembling step of fixing the insulator 2 to the metallic shell 3. Therefore, a problem of a press jig for bending (the bending die 51) coming into contact with the distal end portion of the center-electrode-side noble metal chip 31 does not occur. Therefore, an additional effect can be attained. That is, damage to the center-electrode-side noble metal chip 31, which damage would otherwise occur when the ground electrode 27 is bent, can be prevented reliably.

Further, the distal end surface TS1 is formed through cutting after the ground electrode 27 is bent, and the ground-electrode-side noble metal chip 32 is then welded to the distal end surface TS1. Therefore, damage to the ground-electrode-side noble metal chip 32, which would otherwise occur when the ground electrode 27 is bent, does not occur.

Moreover, in the cutting step, the distal end portion of the ground electrode 27 is cut perpendicularly to the extending direction of the ground electrode 27 as viewed from the front end side with respect to the direction of the axis CL1; and the ground-electrode-side noble metal chip 32 is then joined to the cut surface (the distal end surface TS1) of the ground electrode 27. That is, since the ground-electrode-side noble metal chip 32 is welded after the bent angle of the ground electrode 27 is set, a change in the size of the spark discharge gap 33 attributable to a change in the bent angle can be prevented. Further, the cut surface (the distal end surface) of the ground electrode 27 extends perpendicularly to the extending direction of the ground electrode 27 as viewed from the front end side with respect to the direction of the axis CL1. Therefore, when the cylindrical columnar ground-electrode-side noble metal chip 32 is joined to the cut surface, the distal end surface of the ground-electrode-side noble metal chip 32 can be disposed approximately in parallel with the side surface portion of the center-electrode-side noble metal chip 31.

Next, in order to confirm the effects achieved by the present embodiment, sample metallic shells whose ground electrodes differ in the angle formed between the first straight angle and the second straight angle (corresponding to θ1; hereinafter referred to as the "bent angle") were manufactured, and a breakage resistance evaluation test was performed for the samples. The outline of the breakage resistance evaluation test is as follows. That is, a weight of 50 g was attached to the distal end portion of the ground electrode; vibration was repeated applied thereto for 60 minutes such that the frequency of the vibration increased from 50 Hz to 200 Hz in a 30-second period and decreased from 200 Hz to 50 Hz in a subsequent 30-second period; and a time when a fracture was generated in the ground electrode (fracture generation time) was measured. Notably, of the fracture generation time, a portion corresponding to the second was rounded up (for example, in the case where a fracture occurred at 38 min 40 sec, the fracture generation time was recorded as 39 min).

Further, sample spark plugs whose ground electrodes differ in the bent angle were manufactured, and a sparking position checking test was performed for the samples. The outline of the sparking position checking test is as follows. That is, each sample was brought into a predetermined dirtied state (a state where carbon adhered the insulator), and attached to an engine. The engine was operated in an idling state (1500 rpm), while the air-fuel ratio was maintained at 13 to 14, and discharge waveforms of 100 discharges were obtained. On the basis of the obtained discharge waveforms, there was measured the incidence of spark discharge (lateral sparking) occurred between the ground-electrode-side noble metal chip and the insulator in the 100 discharges) (lateral sparking incidence).

Notably, the "predetermined dirtied state" refers to a state in which carbon is caused to adhere to the surface of the leg portion such that the dielectric resistance between the center electrode and the metallic shell as measured along the insulator (the leg portion) becomes about 1000Ω. Further, in each sample spark plug, a cylindrical columnar center-electrode-side noble metal chip formed of an Ir-11Ru-8Rh-1Ni (diameter: 0.6 mm; length: 2.0 mm) was joined to the distal end portion of the center electrode. In addition, a cylindrical columnar ground-electrode-side noble metal chip formed of a Pt-20Ir (diameter 0.7 mm) was joined to the distal end surface of the ground electrode. In addition, the size of the spark discharge gap was set to 1.05 mm, and the diameter of the thread portion was set to M12. Further, the angle (corresponding to θ2) formed between the axis and the distal end surface of the ground-electrode-side noble metal chip and the angle (corresponding to θ3) formed between the axis and the distal end surface of the ground electrode were both set to 0°, and the distance (corresponding to h) between the ground-electrode-side noble metal chip and the weld portion as measured along the axial direction was set to 0.8 mm. Moreover, the distance (projection amount) between the inner wall surface of the combustion chamber and the distal end of the center-electrode-side noble metal chip as measured along the axis was set to 3.5 mm. Table 1 shows the relation between the bent angle and the fracture generation time and the lateral sparking incidence.

TABLE 1

| Bent angle (°) | Fracture generation time | Lateral sparking incidence |
|---|---|---|
| 90 | 39 min | 0 |
| 115 | 47 min | 0 |
| 120 | No fracture | 0 |
| 125 | No fracture | 0 |
| 140 | No fracture | 0 |
| 150 | No fracture | 21% |

It was found that, as shown in Table 1, when the bent angle is smaller than 120°, a fracture is generated in the ground electrode before elapse of 60 min. Conceivably, this phenomenon occurred for the following reason. As a result of the bent angle of the ground electrode being made relatively small, stress attributable to vibration or the like acted on the bent portion in a more concentrated manner.

Further, it was found that, when the bent angle is in excess of 140°, the lateral sparking incidence becomes 21%, which shows that lateral sparking is likely to occur. Conceivably, this phenomenon occurred for the following reason. As a result of bending the ground electrode at a position closer to the proximal end so as to form a spark discharge gap having a predetermined size, the clearance between the ground electrode and the insulator became smaller.

In contrast, it was found that, when the bent angle falls within a range of 120° to 140° inclusive, no fracture is generated in the ground electrode during the 60-min period, and lateral sparking does not occur. Conceivably, this phenomenon occurred for the following reason. Since the bent angle was 120° or greater, the ground electrode was able to be bent at a position closer to the distal end in order to form a spark discharge gap having the predetermined size, whereby the clearance between the ground electrode and the insulator was able to be made relatively large. Further, since the bent angle was relatively obtuse (140° or smaller), concentration of stress at the bent portion was able to be suppressed.

Figure 5:
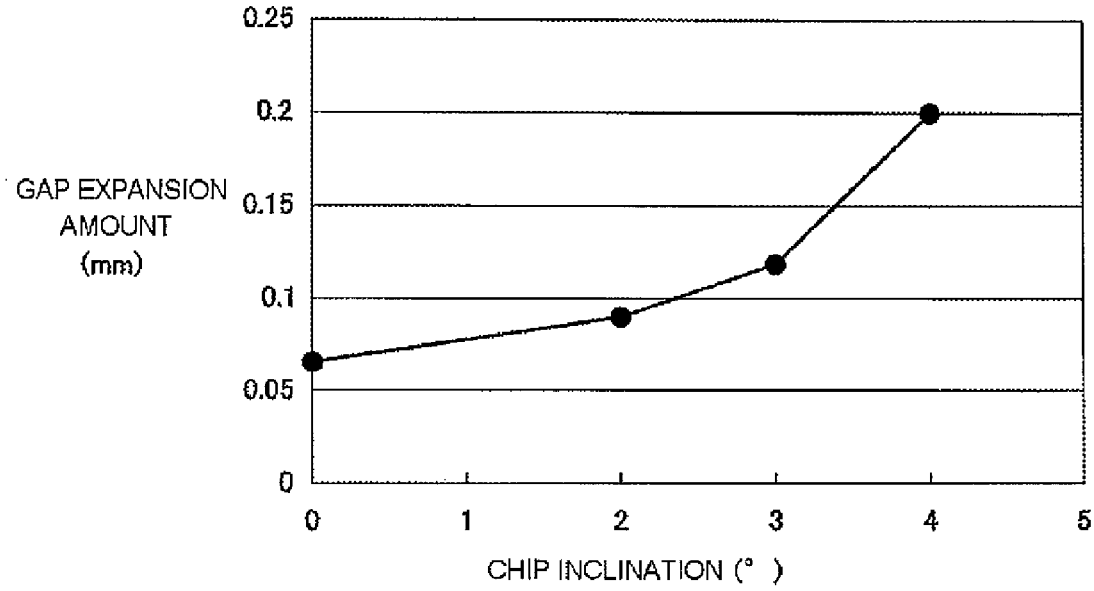
FIG. 5 is a graph showing the relation between chip inclination and gap expansion amount.

Subsequently, sample spark plugs which differ in the angle between the axis and a plane including the distal end surface of the ground-electrode-side noble metal chip (corresponding to θ2; hereinafter referred to as "chip inclination") were manufactured, and an abrasion resistance test was performed for the samples. The outline of the abrasion resistance test is as follows. That is, a plurality of samples having the same chip inclination were assembled to the respective head of a straight-six engine (displacement: 660 cc), and the engine was operated in a full throttle state (4000 rpm), while the air-fuel ratio was set to 10.7, and the ignition timing is set to 5° before top dead center. Every time 300 hours elapsed, the size of the spark discharge gap was measured for a predetermined sample, and the amount of expansion (the gap expansion amount) in relation to the spark discharge gap at the beginning was calculated. In addition, discharge waveforms of 100 discharges were obtained, and the lateral sparking incidence was measured on the basis of the obtained discharge waveforms. Notably, the cylinder positions of the samples were changed every time 50 hours elapsed (rotation). Further, the bent angle of each sample was set to 120°, and the thread portion diameter, the composition of the center-electrode-side noble metal chip, etc. of each sample were the same as those of the samples for which the above-described sparking position checking test was performed, except for the chip inclination. Table 2 shows the relation between the chip inclination and the gap expansion amount and the lateral sparking incidence. FIG. 5 shows a graph representing the relation between the chip inclination and the gap expansion amount.

TABLE 2

| Chip inclination (°) | Gap expansion amount (mm) | Lateral sparking incidence |
|---|---|---|
| 0 | 0.07 | 0 |
| 2 | 0.09 | 0 |
| 3 | 0.12 | 0 |
| 4 | 0.20 | 3% |

It was found that, as shown in Table 2 and FIG. 5, as the chip inclination increases, the spark discharge gap becomes more likely to expand. In particular, when the chip inclination exceeds 3°, the spark discharge gap expands rapidly, and lateral sparking occurs. Conceivably, this phenomenon occurred for the following reason. As a result of the chip inclination being rendered greater, local or uneven abrasion became more likely to occur on the ground-electrode-side noble metal chip or the center-electrode-side noble metal chip, whereby the spark discharge gap expanded rapidly.

In contrast, it was found that, when the chip inclination falls within a range of 0° to 3° inclusive, rapid expansion of the spark discharge gap can be suppressed, because the ground-electrode-side noble metal chip and the center-electrode-side noble metal chip were not abraded locally, and abraded approximately uniform.

Next, spark plug samples which differ in the distance between the ground-electrode-side noble metal chip and the weld portion as measured along the axial direction (corresponding to h; hereinafter referred to as "chip-weld portion distance") were manufactured, and were placed in a high pressure chamber which is formed of quartz and whose interior can be viewed. The samples were caused to discharge, and the front end portion of each sample was photographed during the discharge. On the basis of data of the photographed images, there was measured the incidence of spark discharge occurred between the ground-electrode-side noble metal chip and the weld portion in the 100 discharges (weld portion discharge incidence). Notably, the shape, etc. of each sample were the same as those of the samples for which the above-described abrasion resistance test was performed, except for the chip-weld portion distance. Table 3 shows the relation between the chip-weld portion distance and the weld portion discharge incidence.

TABLE 3

| Chip-weld portion distance (mm) | Weld portion discharge incidence |
|---|---|
| 0.3 | 9% |
| 0.6 | 0% |
| 0.8 | 0% |
| 1.5 | 0% |
| 2.0 | 0% |
| 2.5 | 0% |

In was found that, as shown in FIG. 3, in the case of the sample whose chip-weld portion distance is less than 0.6 mm, the weld portion discharge incidence becomes 9%, and anomalous spark discharge is likely to occur between the ground-electrode-side noble metal chip and the weld portion. Conceivably, this phenomenon occurred because of the excessively short distance between the ground-electrode-side noble metal chip and the weld portion.

In contrast, it was found that each sample whose chip-weld portion distance is 0.6 mm or greater did not cause sparking to the weld portion, and had excellent ignitable, because of the following reason. Since the distance between the ground-electrode-side noble metal chip and the weld portion is rendered relatively large, spark discharge between the ground-electrode-side noble metal chip and the weld portion can be suppressed effectively.

Notably, when the chip-weld portion distance is increased, the ground electrode and the center-electrode-side noble metal chip project toward the center of a combustion chamber by a greater amount, so that durability lowers. Therefore, preferably, the chip-weld portion distance is set to a distance (e.g., 2.5 mm or less) determined such that the ground electrode and the center-electrode-side noble metal chip have a sufficient degree of durability.

When the results of the above-described tests are totally considered, setting the bent angle to fall within the range of 120° to 140° inclusive and setting the chip inclination to fall within the range of 0° to 3° inclusive can realize excellent durability and breakage resistance, while preventing ignitability from deteriorating. Further, from the viewpoint of preventing the deterioration of ignitability more reliably, more preferably, the chip-weld portion distance is set to 0.6 mm or greater.

Notably, the present invention is not limited to the details of the above-described embodiment, and may be embodied as follows. Needless to say, other applications and modifications which are not illustrated below are also possible.

Figure 6:
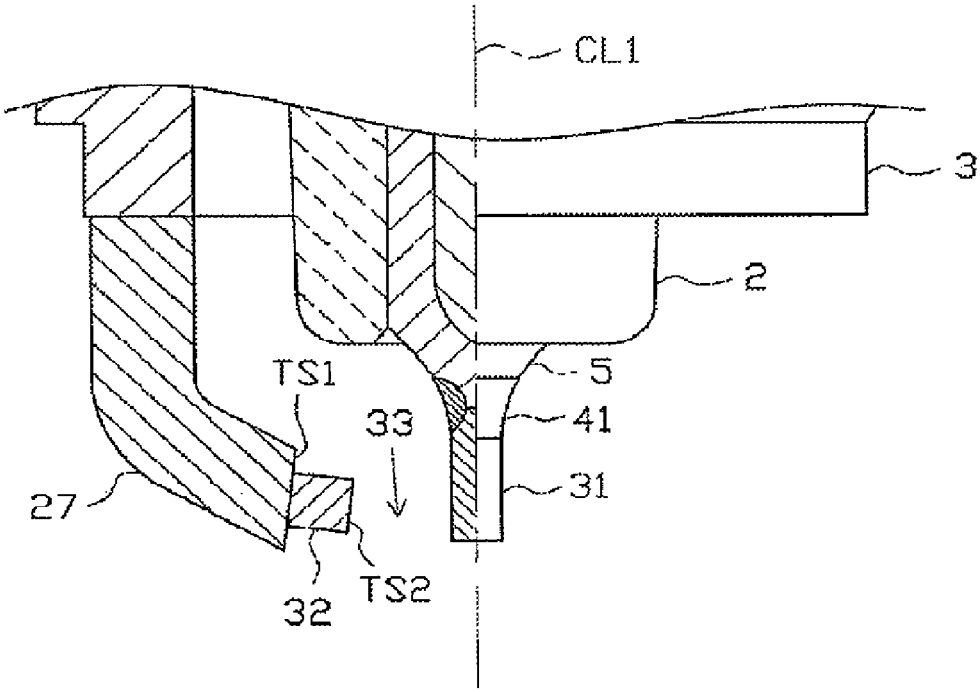
FIG. 6 is a partially-sectioned, enlarged view showing the configuration of a front end portion of a spark plug according to another embodiment.

(a) In the above-described embodiment, the spark plug is configured such that the greater part of the distal end surface TS2 of the ground-electrode-side noble metal chip 32 faces the side surface portion of the center-electrode-side noble metal chip 31. However, the spark plug may be configured such that, as shown in FIG. 6, the entirety of the distal end surface TS2 of the ground-electrode-side noble metal chip 32, as viewed along the direction of the axis CL1, faces the side surface portion of the center-electrode-side noble metal chip 31. In such a case, uneven abrasion of the ground-electrode-side noble metal chip 32 and the center-electrode-side noble metal chip 31 can be suppressed to a greater degree, and each of the two noble metal chips 31 and 32 can have an increased volume which can abrade. As a result, durability, etc. can be improved further.

(b) In the above-described embodiment, the noble metal material which constitutes the center-electrode-side noble metal chip 31 has not been described specifically. However, the center-electrode-side noble metal chip 31 may be formed of an Ir alloy which contains iridium (Ir) as the predominant component. Since the Ir alloy has a relatively high melting point and excellent strength, even when the center-electrode-side noble metal chip 31 is disposed in such a manner that the center-electrode-side noble metal chip 31 projects from the weld portion 41 by a relatively large amount, it is possible to more reliably prevent the center-electrode-side noble metal chip 31 from suffering melting, breakage, or the like. Notably, in order to improve durability further, the center-electrode-side noble metal chip 31 may be formed of an alloy which contains Ir (predominant component), ruthenium (Ru), and rhodium (Rh).

(c) In the above-described embodiment, the noble metal material which constitutes the ground-electrode-side noble metal chip 32 has not been described specifically. However, the ground-electrode-side noble metal chip 32 may be formed of a Pt alloy which contain platinum (Pt) as the predominant component. Since the Pt alloy is excellent in oxidation resistance, the abrasion resistance of the ground-electrode-side noble metal chip 32 can be improved. Notably, in order to improve durability, the ground-electrode-side noble metal chip 32 may be formed of an alloy which contains Pt (predominant component) and at least one of Ir, Rh, and Ni.

(d) In the above-described embodiment, the center-electrode-side noble metal chip 31 and the ground-electrode-side noble metal chip 32, each formed of a noble metal material, are used as the center-electrode-side chip and the ground-electrode-side chip, respectively. However, the materials which constitute the center-electrode-side chip and the ground-electrode-side chip are not limited to noble metal materials. Accordingly, the center-electrode-side chip and the ground-electrode-side chip may be formed of, for example, a material which contains a base metal such as tungsten as a base and which is excellent in spark abrasion resistance.

(e) In the above-described embodiment, the distance d between the front end of the inner circumferential surface of the metallic shell 3 and the distal end surface TS1 of the ground electrode 27 as measured along the direction of the axis CL1 is set to 1.5 mm or less. However, no particular limitation is imposed on the distance d. Accordingly, the distance d may be made smaller (e.g., 0.9 mm or less). Notably, in this case, the ground electrode 27 is bent with a smaller radius of curvature, so that concerns arise over a drop in breakage resistance. However, since the bent angle θ1 is relatively obtuse (within a range of 120° to 140° inclusive), such concerns can be dispelled. That is, in the case where the distance d is rendered smaller, setting the bent angle θ1 to fall within the range of 120° to 140° inclusive is more meaningful.

(f) In the above-described embodiment, the ground-electrode-side noble metal chip 32 is joined directly to the ground electrode 27. However, the ground-electrode-side noble metal chip 32 may be joined indirectly to the ground electrode 27 via a pedestal formed of, for example, a Ni alloy. In this case, the ground-electrode-side noble metal chip 32 can be joined to the ground electrode 27 more strongly, and it is possible to prevent heat of the flame kernel from escaping via the ground electrode 27, whereby more excellent ignitability can be realized.

(g) In the above-described embodiment, the present invention is applied to the case where the ground electrode 27 is joined to the front end surface of the front end portion 26 of the metallic shell 3. However, the present invention may be applied to the case where the ground electrode is formed by means of cutting a portion of the metallic shell (or a portion of a front end metal piece welded to the metallic shell in advance) (for example, Japanese Patent Application Laid-Open (kokai) No. 2006-236906). Further, the ground electrode 27 may be joined to a side surface of the front end portion 26 of the metallic shell 3.

(h) In the above-described embodiment, the tool engagement portion 19 has a hexagonal cross section. However, no limitation is imposed on the shape of the tool engagement portion 19. For example, the tool engagement portion 19 may have a Bi-HEX shape (a modified dodecagonal shape) [IS022977: 2005(E)] or a like shape.

(i) In the above-described embodiment, before the step of bending the ground electrode 27, plating such as zinc plating is performed on the metallic shell 3 to which the ground electrode 27 has been welded. However, plating may be performed after the ground electrode 27 is bent. In this case, exfoliation of plating (drop in corrosion resistance) due to bending of the ground electrode 27 can be prevented.

(j) In the above-described embodiment, the distal end portion of the ground electrode 27 is cut by means of punching operation in which the cutting blade 61, which serves as cutting means, is moved along the axis CL1. However, the distal end portion of the ground electrode 27 may be cut by moving the cutting blade in a direction perpendicular to the axis CL1. In such a case, the cutting blade does not approach the metallic shell along the direction of the axis CL1, and a clearance of a predetermined size or more is formed between the cutting blade and the metallic shell 3. Therefore, contact of the cutting blade with the metallic shell 3 and the resultant damage to the metallic shell 3 can be prevented more reliably.

Figure 9:
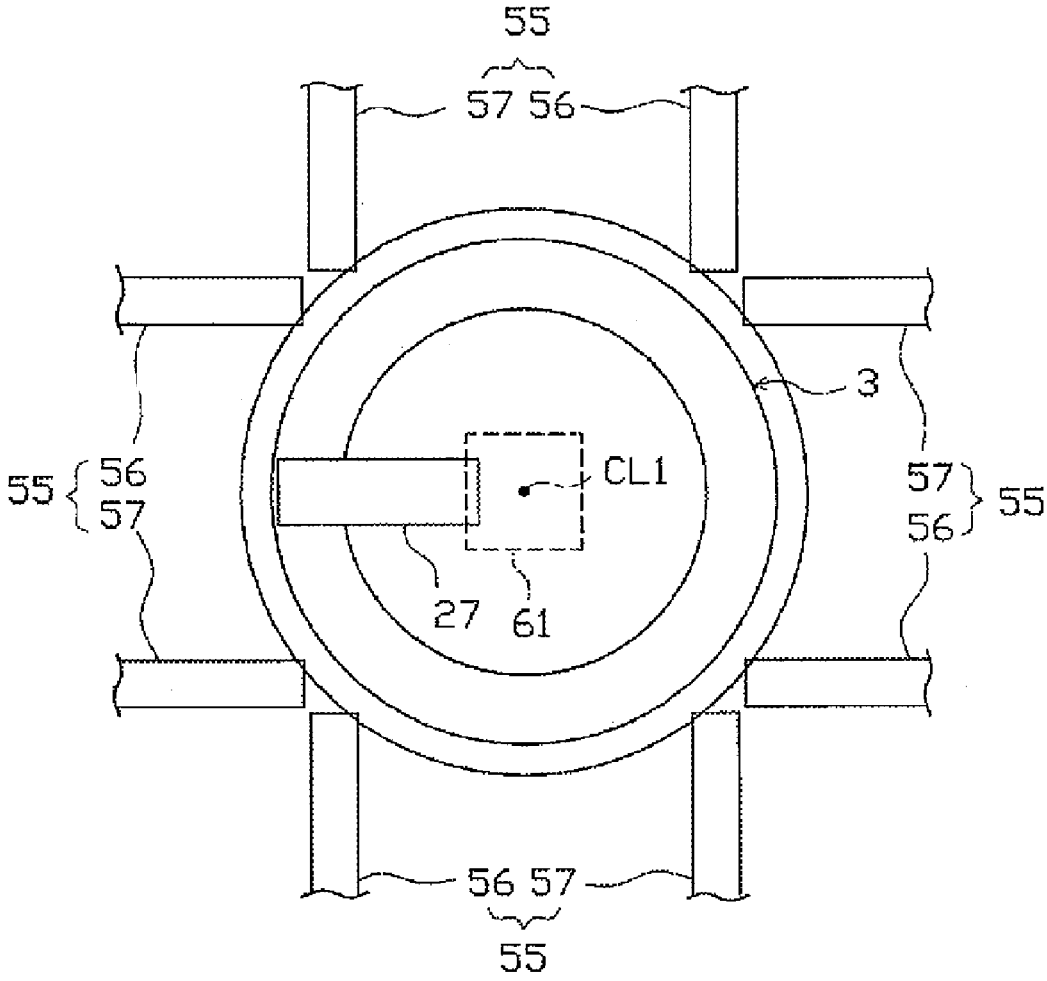
FIG. 9 is a schematic plan view relating to another embodiment which shows guides, etc., used during a cutting step.

(k) In the above-described embodiment, as shown in FIG. 8, the guide 55 having the paired nipping portions 56 and 57 is disposed only on the left side of the sheet of FIG. 8. However, as shown in FIG. 9, the nipping portions 56 and 57 may be disposed at four locations; i.e., on the upper, lower, left, and right sides. Further, in this case, the cutting blade 61 used to perform punching operation may be disposed in such a manner that its cutting portions (cutting edges) face the corresponding guides 55. This configuration can shorten the cycle time of the operation of cutting the front end portion of the ground electrode 27. Of course, the layout of the guides is not limited to that shown in FIG. 9 in which the guides are disposed at 4 locations at 90° intervals. It is possible to provide a plurality of guides, and use a cutting blade which is arranged and formed such that its cutting edges face the corresponding guides.

(l) In the above-described embodiment, the projection length of the center-electrode-side noble metal chip 31 from the front end of the metallic shell 3 as measured along the axis CL1 is approximately equal to the projection length of the ground electrode 27 from the front end of the metallic shell 3 as measured along the axis CL1. However, these projection lengths may differ from each other.

The invention claimed is:

1. A spark plug for an internal combustion engine, comprising:

a rod-like center electrode;

a tubular insulator having an axial hole extending along the direction of an axis of the center electrode and holding the center electrode placed in the axial hole;

a tubular metallic shell provided radially outward of the insulator;

a ground electrode extending from a front end portion of the metallic shell and bent such that a distal end of the ground electrode is directed toward the axis;

a center-electrode-side chip joined to a distal end of the center electrode and extending from the center electrode along the direction of the axis; and a ground-electrode-side chip joined to a distal end surface of the ground electrode, the ground-electrode-side chip being thinner than the distal end surface of the ground electrode and having a distal end surface which faces a side surface portion of the center-electrode-side chip, wherein an angle θ1 formed between a first straight line and a second straight line falls within a range of 120° to 140° inclusive, the first straight line passing through the center of a proximal end surface of the ground electrode which borders on the front end portion of the metallic shell and the center of a cross section of the ground electrode at a position separated from the center of the proximal end surface toward the distal end by 0.5 mm as measured along the direction of the axis, and the second straight line passing through the center of a distal end surface of the ground electrode and the center of a cross section of the ground electrode at a position separated from the center of the distal end surface of the ground electrode toward the proximal end portion of the ground electrode by 0.5 mm as measured along a direction perpendicular to the axis;

an angle θ2 formed between the axis and a plane including the distal end surface of the ground-electrode-side chip falls within a range of 0° to 3° inclusive; and a minimum distance between the insulator and the ground electrode is greater than a minimum distance between the distal end surface of the ground-electrode-side chip and the side surface portion of the center-electrode-side chip so as to generate a spark discharge between the ground-electrode-side chip and the center-electrode-side chip.

2. The spark plug according to claim 1, wherein the insulator includes: a cylindrical portion having a uniform outer diameter in the front end portion of the insulator; and an outer diameter transition part connected to the cylindrical portion at the rear end side with respect to the cylindrical portion in the axial direction and having an outer diameter that enlarges from the front end side toward the rear end side, and wherein a second border is positioned at the front end side with respect to a first border in the axial direction, where the first border serves as a border between the cylindrical portion of the insulator and the outer diameter transition part in the axial direction, and the second border serves as a border between the inner circumferential face of the metal shell and the first face.

3. The spark plug according to claim 1, wherein the virtual sphere is in contact with the inner face of the bending portion at the front end side with respect to at least any one of the plurality of faces that constitute the front end constituent face of the metal shell in the axial direction in the state that the virtual sphere is neither in contact with the center electrode nor the insulator.

4. The spark plug according to claim 1, wherein a relationship:

120 degrees<=α<=150 degrees, is satisfied, where "α" is an angle formed by the inner circumferential face and the first face of the metal shell on a cross-sectional outline of the metal shell including the axis thereof.

5. The spark plug according to claim 1, wherein the metal shell includes a second face as one of the plurality of faces constituting the front end constituent face, the second face comprised of a face perpendicular to the axis of the metal shell or an inclined face having a diameter reduced toward the front end side from the rear end side in the axial direction.

* * * * *